US006622539B2

(12) United States Patent
Hartzinger et al.

(10) Patent No.: US 6,622,539 B2
(45) Date of Patent: Sep. 23, 2003

(54) DEEP-DRAWING METHOD AND DEEP-DRAWING DIE

(75) Inventors: Josef Hartzinger, Kürnbach (DE); Torsten Krachhudel, Zaisenhausen (DE); Franz Kaderabek, Bretten (DE)

(73) Assignee: Blanco GmbH + Co KG, Oberderdingen (DE)

( * ) Notice: Subject to any disclaimer, the term of this patent is extended or adjusted under 35 U.S.C. 154(b) by 0 days.

(21) Appl. No.: 10/044,133

(22) Filed: Jan. 10, 2002

(65) Prior Publication Data

US 2002/0083756 A1 Jul. 4, 2002

Related U.S. Application Data

(63) Continuation of application No. PCT/EP01/02795, filed on Mar. 13, 2001.

(30) Foreign Application Priority Data

May 13, 2000 (DE) ..... 100 23 533

(51) Int. Cl.[7] ..... B21D 22/33; B21D 39/08

(52) U.S. Cl. ..... 72/57; 72/347; 72/351

(58) Field of Search ..... 72/57, 347, 351

(56) References Cited

U.S. PATENT DOCUMENTS 3,568,487 A * 3/1971 Lyon ..... 72/347
3,739,616 A * 6/1973 Matthews ..... 72/57
4,331,017 A 5/1982 Bulso, Jr. et al.
4,361,020 A * 11/1982 Hirota et al. ..... 72/57
4,472,955 A * 9/1984 Nakamura et al. ..... 72/57
4,550,585 A * 11/1985 Sasaki ..... 72/351
5,687,598 A * 11/1997 Kirii et al. ..... 72/351
5,740,692 A * 4/1998 Dunwoody ..... 72/347
5,755,129 A * 5/1998 Yamasaki ..... 72/57

FOREIGN PATENT DOCUMENTS

DE 19608985 A 9/1997
EP 0015218 A1 9/1980

OTHER PUBLICATIONS

International Search Report (Jul. 4, 2001).

* cited by examiner

*Primary Examiner*—David B. Jones
(74) *Attorney, Agent, or Firm*—Townsend and Townsend and Crew, LLP

(57) ABSTRACT

In order to provide a deep-drawing method, with which a drawn part is arranged in a deep-drawing die between a first deep-drawing die part and a second deep-drawing die part and is formed by way of relative movement of the deep-drawing die parts in relation to one another, which—particularly for carrying out several consecutive drawing processes—is more time and energy saving than the known deep-drawing methods, it is suggested that a pressure variable with time during the drawing process be generated selectively at a limited pressure section of one of the deep-drawing die parts, this pressure pressing a section of the drawn part abutting on the pressure section against the respectively other deep-drawing die part.

33 Claims, 13 Drawing Sheets

DEEP-DRAWING METHOD AND DEEP-DRAWING DIE

This is a continuation of International Application No. PCT/EP01/02795, with an International filing date of Mar. 13, 2001, published in German under PCT Article 21(2) which is incorporated herein by reference in its entirety and for all purposes.

BACKGROUND OF THE INVENTION

The present invention relates to a deep-drawing method, with which a drawn part is arranged in a deep-drawing die between a first deep-drawing die part and a second deep-drawing die part and is formed by way of relative movement of the deep-drawing die parts in relation to one another.

Such deep-drawing methods are known from the state of the art.

In particular, deep-drawing methods with rigid deep-drawing die parts are known, with which the drawn part is drawn by a drawing punch into a drawing member (also called a female die), wherein the edge of the drawn part can be held securely by means of a drawing ring.

In order to achieve the desired, final configuration of the drawn part, it is often necessary to form the drawn part in several consecutive drawing processes (also called operations).

In this respect, there is, however, the problem that the structure of the material of the drawn part will be solidified during the first drawing process such that it no longer has sufficient fluidity for an additional drawing process which can lead to the formation of cracks during the additional drawing process.

If the material of the drawn part is steel, martensite is formed, in particular, during the first drawing process and this reduces the formability of the drawn part during an additional deep-drawing process.

In the case of the known, multiple operation deep-drawing methods, the required formability of the drawn part is therefore established again following the first deep-drawing process in that the drawn part is annealed at a temperature of approximately 1050° C., wherein the martensite, in particular, which has been formed during the first deep-drawing process, is converted into austenite which can be formed more easily.

If more than two deep-drawing processes follow one another, the annealing of the drawn part will possibly have to be repeated after each deep-drawing process.

On account of the annealing, cooling and washing processes required prior to each additional drawing process, the known, multiple operation deep-drawing methods require considerable time and energy.

SUMMARY OF THE INVENTION

It is therefore an object of the present invention to provide a deep-drawing method of the type described at the outset which—particularly when carrying out several consecutive drawing processes—is more time- and energy-saving than the known deep-drawing methods.

The present invention relates, in addition, to a deep-drawing die, comprising a first deep-drawing die part and a second deep-drawing die part, in which a drawn part can be formed by way of relative movement of the deep-drawing die parts in relation to one another.

A further object underlying the present invention is to provide such a deep-drawing die, with the aid of which drawn parts—in particular within the scope of a multiple operation deep-drawing method—can be formed in a more time- and energy-saving manner than with known deep-drawing dies.

These objects are accomplished in accordance with the invention, in a deep-drawing method using cooperating deep-drawing die parts, in that a pressure variable with time during the drawing process is generated selectively at a limited pressure section of one of the deep-drawing die parts, this pressure pressing a section of the drawn part, which abuts on the pressure section, against the other deep-drawing die part.

The idea underlying the inventive solution is to achieve a flow of the material of the drawn part sufficient for its forming by concertedly acting upon a limited area of the drawn part during the drawing process even when the flowability of the material of the drawn part is reduced as such on account of the previous history of the material, for example on account of a preceding, earlier drawing process.

The desired formability of the drawn part can be ensured, in particular, with the inventive deep-drawing method even when the drawn part contains martensite on account of a preceding drawing process.

An annealing process and the cooling and washing processes associated with the annealing process may be omitted in the case of the inventive deep-drawing method even when the deep-drawing method is carried out in several operations.

The inventive deep-drawing method allows a particularly large drawing ratio to be achieved and leads to a high form stability of the drawn parts.

In a preferred development of the inventive method it is provided for the pressure at the pressure section to be generated hydraulically or pneumatically by means of a pressure fluid.

The hydraulic generation of a pressure at one of the deep-drawing die parts is already known as such from the so-called hydroforming method, with which the drawing member is provided with a membrane which is subjected to water pressure during the forming process. With this method, the drawing punch presses the drawn part against the membrane on the drawing member, wherein the drawn part is formed by the water pressure acting against it. With this method, the entire drawn part is, however, subjected to the same water pressure during the drawing process whereas, in the inventive deep-drawing method, a pressure is generated selectively only at a limited pressure section of one of the deep-drawing die parts and this pressure presses the respective limited section of the drawn part, which abuts on the pressure section, against the respectively other deep-drawing die part.

Moreover, in the case of the hydroforming method the water pressure acting on the drawn part is constant during the drawing process.

One variation of the hydroforming method is the so-called hydro-mec method, with which the drawn part is pressed by a descending drawing punch into water subjected to pressure without a membrane being provided on the drawing member. With this method, as well, no selective action on a limited section of the drawn part with a pressure variable with time during the drawing process is provided.

A uniform distribution of the hydraulic pressure on the surface of the drawn part is the aim not only of the hydroforming method but also of the hydro-mec method and this is completely contrary to the inventive idea of acting upon a limited section of the drawn part selectively with an increased pressure.

In a preferred development of the inventive deep-drawing method it is provided for the pressure at the pressure section to be controlled and/or regulated in accordance with a predetermined temporal pressure course.

This pressure course may provide, for example, for the pressure section to be switched to a no-pressure state during a first forming phase and for an increased pressure constant throughout a second forming phase to be generated at the pressure section during the second forming phase. Such a pressure course can be controlled and/or regulated particularly simply.

However, any optional, other temporal pressure course can also be controlled and/or regulated depending on the type of drawn part and the desired forming of the drawn part.

The formability of the drawn part during the drawing process is particularly increased when the pressure section is aligned essentially parallel to the direction of drawing, along which the deep-drawing die parts are moved relative to one another. In this case, areas of the drawn part which are aligned essentially parallel to the direction of drawing can be pressed concertedly onto areas of the respectively other deep-drawing die part which are aligned essentially parallel to the direction of drawing, and this is not possible in the case of the conventional deep-drawing methods. Side wall areas of the drawn part, which are aligned essentially parallel to the direction of drawing, can, in particular, be formed in a particularly exact manner.

The inventive deep-drawing method has proven to be particularly successful when the side wall of the drawn part is exclusively acted upon during the drawing process with the pressure variable with time at the pressure section. Such a deep-drawing method is particularly suitable for the production of Gastronorm food containers which have a great depth and tend to form undesired bulges in the side wall area which can lead to a poor stacking capability of the food containers. Such bulging can be prevented or any bulge generated during a preceding deep-drawing process eliminated as a result of the concerted action on the side wall of the Gastronorm food container during the drawing process with the pressure variable with time at the pressure section.

In a preferred development of the inventive deep-drawing method it is provided for the pressure section to be of a ring-shaped design.

No further details have so far been given as to how the pressure variable with time is generated at the pressure section.

It may be provided for the pressure variable with time to be generated by means of a pressure generating device which comprises a chamber for accommodating a pressure fluid subject to pressure and an elastically deformable chamber wall for transferring the pressure from the pressure fluid to the drawn part.

Such a chamber may, in particular, be of a ring-shaped design.

Such a chamber is particularly easy to produce when it is limited partially by the elastically deformable chamber wall and partially by a chamber limiting wall consisting of a material different from the material of the elastically deformable chamber wall, preferably consisting of a metallic material, in particular, aluminum.

In principle, the pressure section may be arranged on the first deep-drawing die part or on the second deep-drawing die part. Furthermore, it may be provided for not only the first deep-drawing die part but also the second deep-drawing die part to each have one or more pressure sections, at which a respective pressure variable with time is generated during the drawing process.

In a preferred development of the inventive deep-drawing method it is provided for the first deep-drawing die part to be designed as a drawing member and the second deep-drawing die part as a drawing punch and for the pressure section to be arranged on the drawing member.

In principle, the relative movement between the drawing punch and the drawing member required for forming the drawn part may be generated not only by a movement of the drawing punch but also a movement of the drawing member or also by a movement of both deep-drawing die parts.

In a preferred development of the inventive deep-drawing method it is provided for the drawing punch to be stationary during the drawing process and the drawing member to be moved towards the drawing punch.

As already explained, the inventive deep-drawing method is particularly advantageous when the drawn part is preformed during a first drawing process and postformed during a second drawing process, during which the pressure variable with time is generated at the pressure section. In this case, the annealing required with the known deep-drawing methods and the cooling and washing processes necessary as a result prior to the second drawing process can be dispensed with, which results in a considerable saving on time and energy.

The two drawing processes may be carried out in the same deep-drawing die, wherein it is normally necessary to change the deep-drawing die parts between the drawing processes, or the two drawing processes are carried out in different deep-drawing dies, which is recommended for a series production since, in this case, the deep-drawing die parts required for the respective drawing process can remain in the respective deep-drawing die.

The further object is accomplished in accordance with the invention in that one of the deep-drawing die parts has a limited pressure section, at which a pressure variable with time can be generated selectively during the drawing process, this pressure pressing a section of the drawn part which abuts on the pressure section against the respectively other deep-drawing die part.

The advantages of the inventive deep-drawing die have already been explained above in conjunction with the inventive deep-drawing method.

Additional features and advantages of the invention are the subject matter of the following description and drawings illustrating one embodiment.

DETAILED DESCRIPTION OF THE INVENTION

Figure 1:
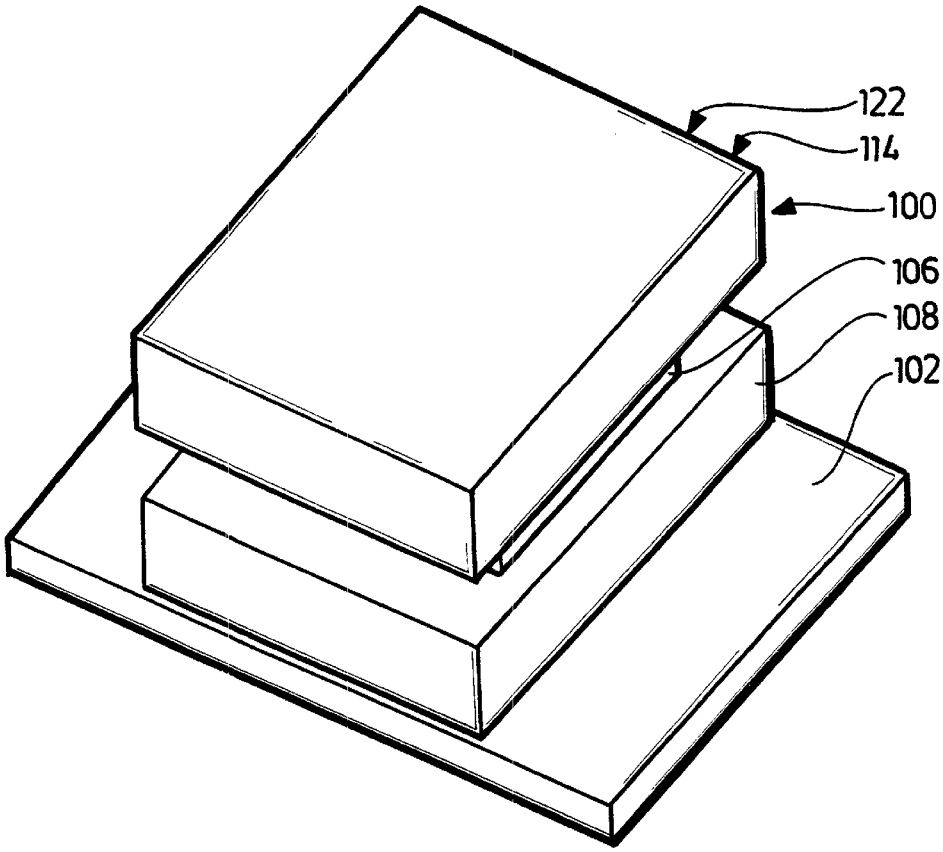
FIG. 1 shows a schematic perspective illustration of a deep-drawing die.

The same or functionally equivalent elements are designated in all the Figures with the same reference numerals.

A deep-drawing die illustrated schematically in FIGS. 1 to 5 and designated as a whole as 100 comprises a base plate 102, a drawing punch 104 arranged stationarily on the upper side of the base plate 102, and a sheet-metal holder 106 which surrounds the drawing punch 104 in a ring shape and is arranged on a supporting plate 108 which likewise surrounds the drawing punch 104 in a ring shape and is borne by spindle sleeves 110 which can be moved vertically by means of a hydraulic moving device (not illustrated) so that the supporting plate 108 can be moved with the sheet metal holder 106 arranged thereon along the vertical direction of drawing 112.

Furthermore, the deep-drawing die 100 comprises a drawing member 114 which is arranged above the drawing punch 104 and the sheet metal holder 106 and comprises, for its part, a ring-shaped drawing ring support 116 and a drawing ring 118 held on its underside.

The drawing ring support 116 is held at its upper side on a holding plate 120 which can be moved by means of a hydraulic moving device (not illustrated) along the direction of drawing 112 relative to the drawing punch 104 and the sheet metal holder 106.

The drawing member 114 forms the first deep-drawing die part 122 of the deep-drawing die 100; the drawing punch 104 forms the second deep-drawing die part 124 of the deep-drawing die 100.

A first deep-drawing process is carried out as follows with the deep-drawing die 100 described above.

First of all, the drawing member 114 and the sheet metal holder 106 are displaced into their respective upper starting positions by means of the respective hydraulic moving devices (not illustrated).

In the upper starting position of the sheet metal holder 106, the essentially flat upper side of the sheet metal holder 106 is arranged above the upper side of the drawing punch 104.

Figure 2:
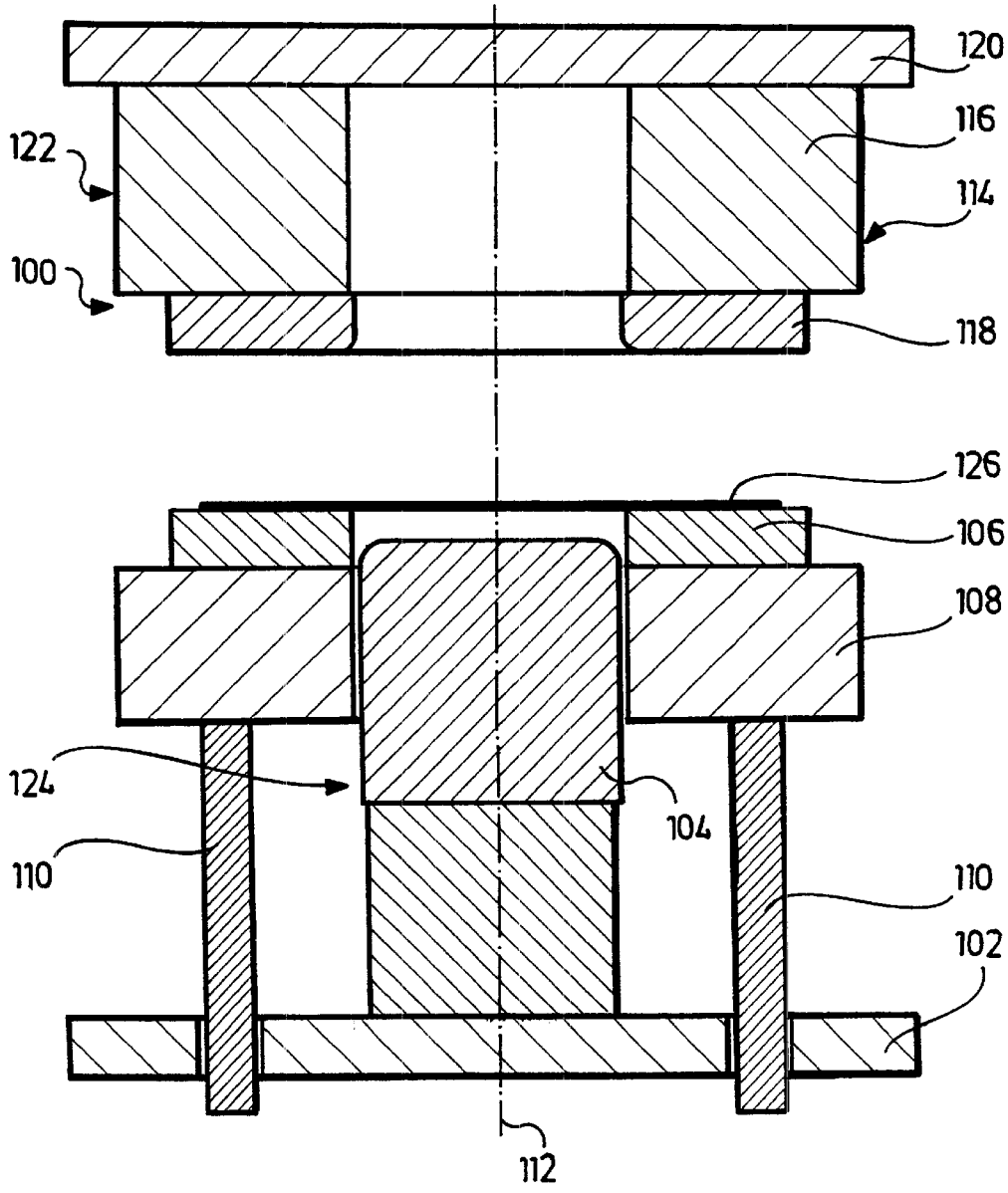
FIGS. 2–5 show schematic cross-sections through the deep-drawing die from FIG. 1 in four different phases of a conventional deep-drawing process.

In this position, a sheet metal blank or a plate 126, from which the drawn part is intended to be produced, is inserted into the deep-drawing die 100 such that the edge of the plate 126 rests on the sheet metal holder 106 (cf. FIG. 2).

Figure 3:
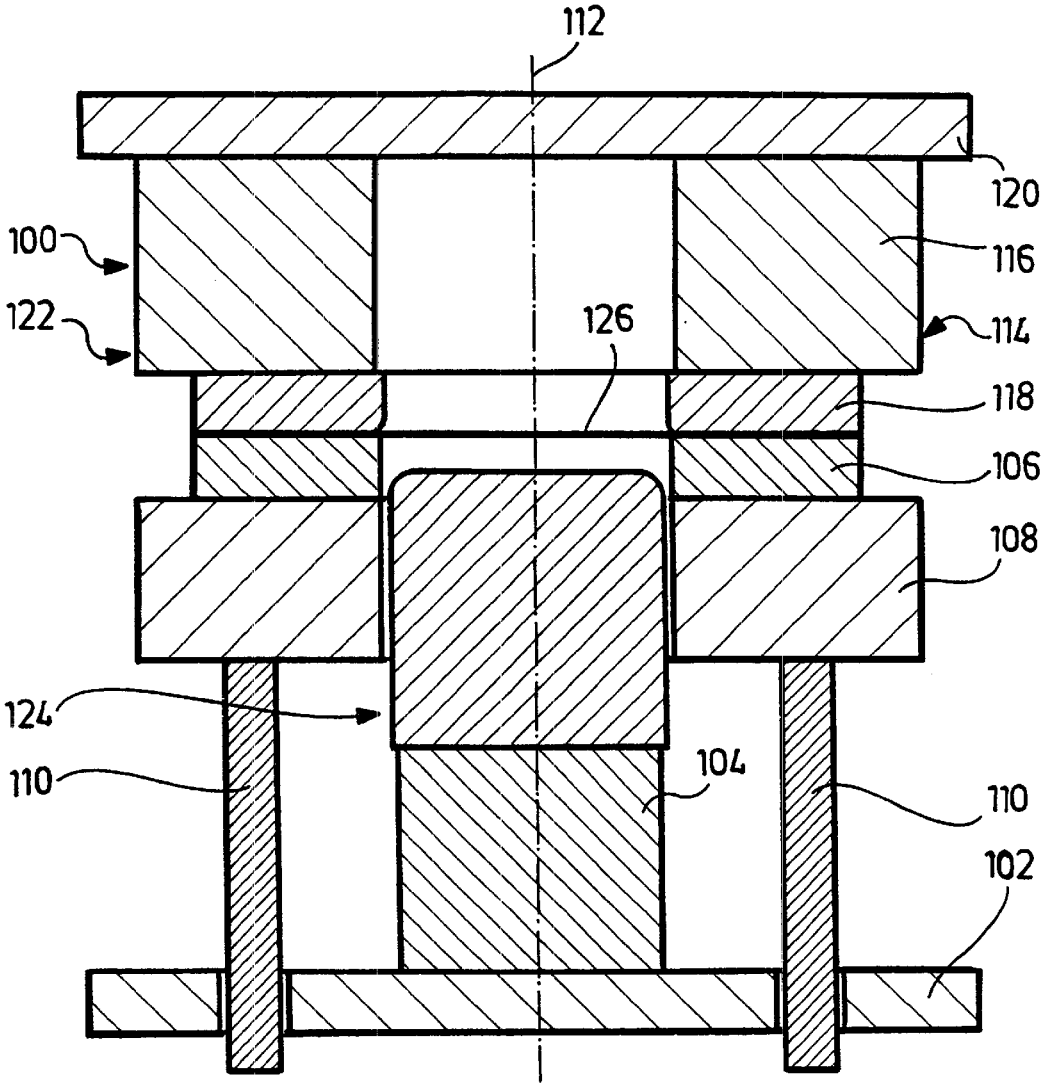

Subsequently, the deep-drawing die 100 is closed in that the drawing member is displaced by means of the hydraulic moving device (not illustrated) downwards out of its upper starting position to such an extent along the direction of drawing 112 until the underside of the drawing ring 118 rests on the upper side of the plate 126 and the edge of the plate 126 is clamped between the drawing ring 118 and the sheet metal holder 106 (cf. FIG. 3).

Figure 4:
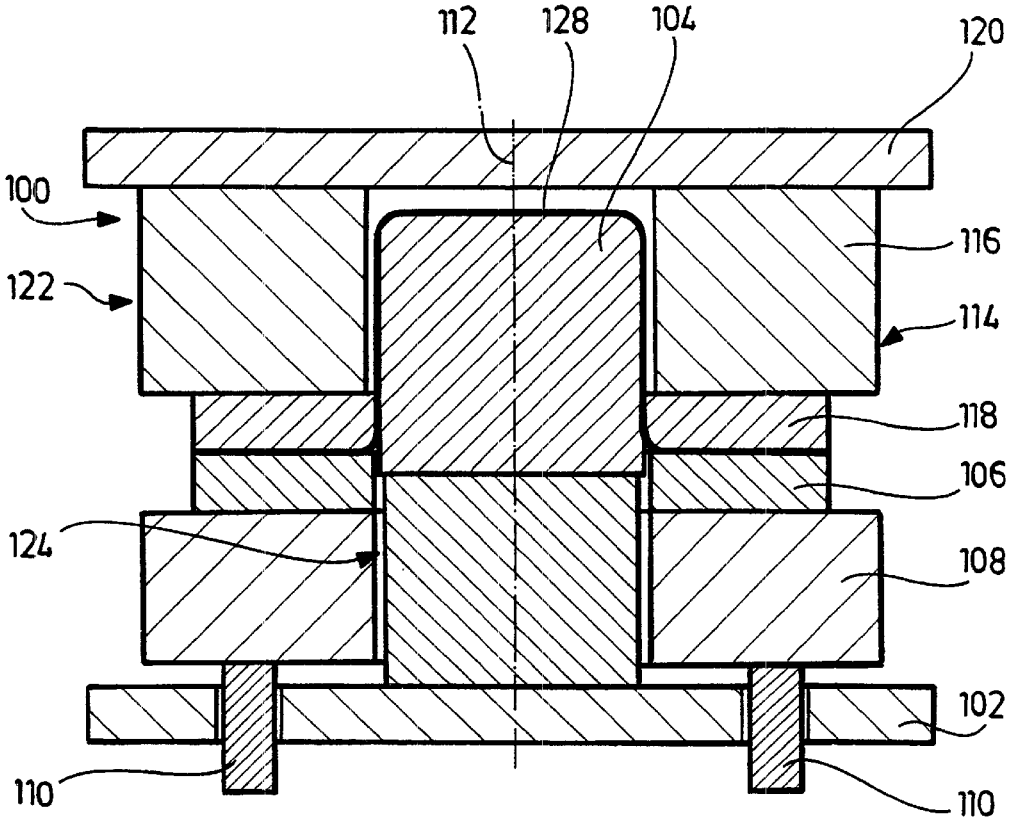

In the subsequent method step, the plate 126 is formed into a drawn part 128 in that the spindle sleeves 110 with the supporting plate 108 arranged thereon and the sheet metal holder 106 as well as the drawing member 114 are moved downwards by means of the hydraulic moving device (not illustrated) along the direction of drawing 112 relative to the drawing punch 104 by the drawing depth, wherein the plate 126 held securely at its edge between the drawing ring 118 and the sheet metal holder 106 fits closely along the outer contours of the drawing ring 118 and the drawing punch 104 (cf. FIG. 4).

Figure 5:
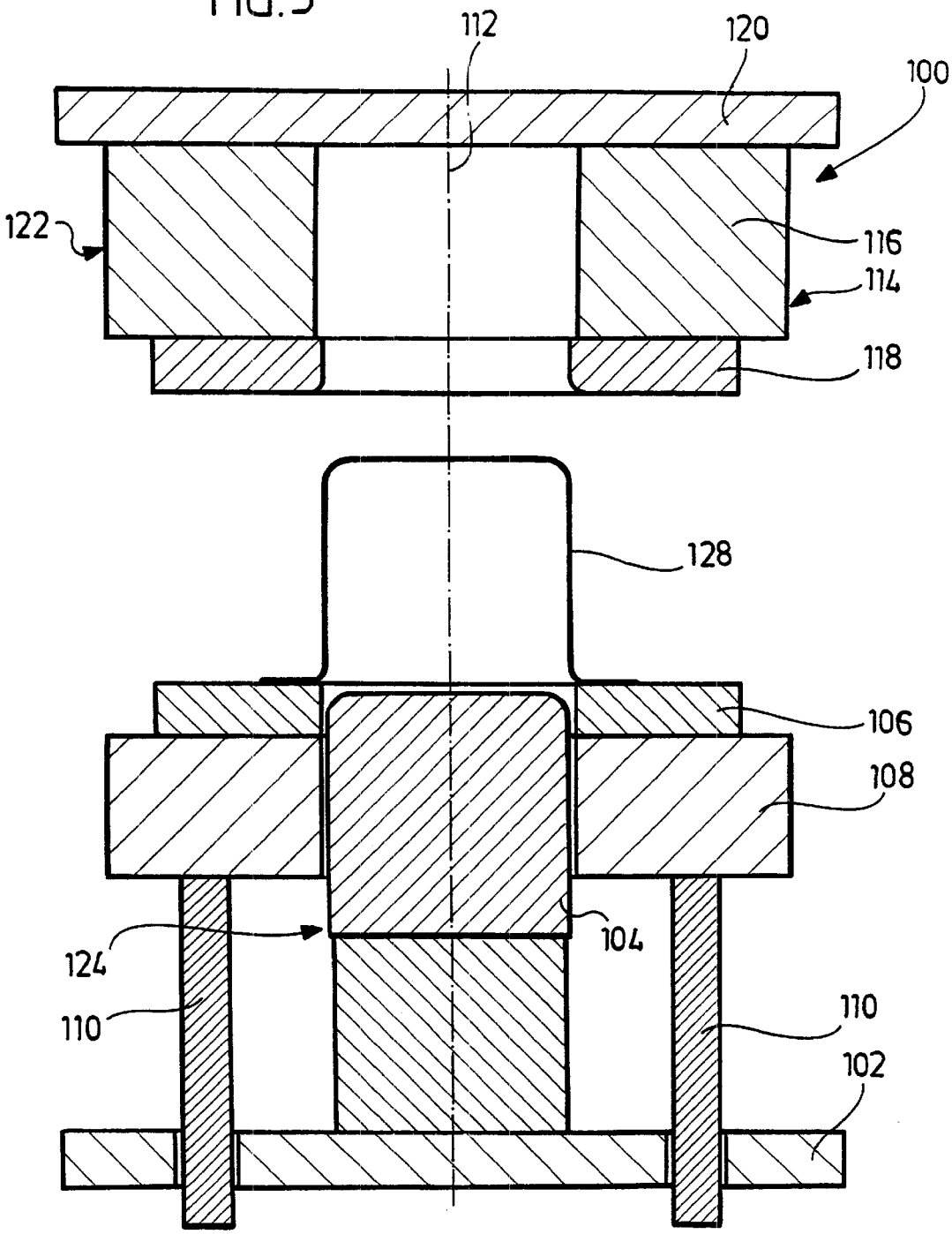

Once the desired drawing depth for the first deep-drawing process is reached, the spindle sleeves 110 are moved back into their upper starting position with the supporting plate 108 arranged thereon and the sheet metal holder 106 and the deep-drawing die 100 is opened in that the drawing member 114 is moved further along the direction of drawing 112 upwards into its upper starting position (cf FIG. 5).

As a result, the drawn part 128 formed during the first deep-drawing process is accessible from outside the deep-drawing die 100 and can be removed from it.

Following this first deep-drawing process the deep-drawn part 128 has not yet been given the desired final shape.

In the present example, the finished drawn part is intended to have the shape of a Gastronorm food container which is provided with a stacking lip 132 extending around beneath its upper edge 130. Moreover, the depth of the finished food container is intended to be greater than the depth of the drawn part 128 following the first deep-drawing process whereas the length and the width of the finished food container in the side wall area are intended to be less than in the case of the drawn part 128 resulting from the first drawing process.

Figure 6:
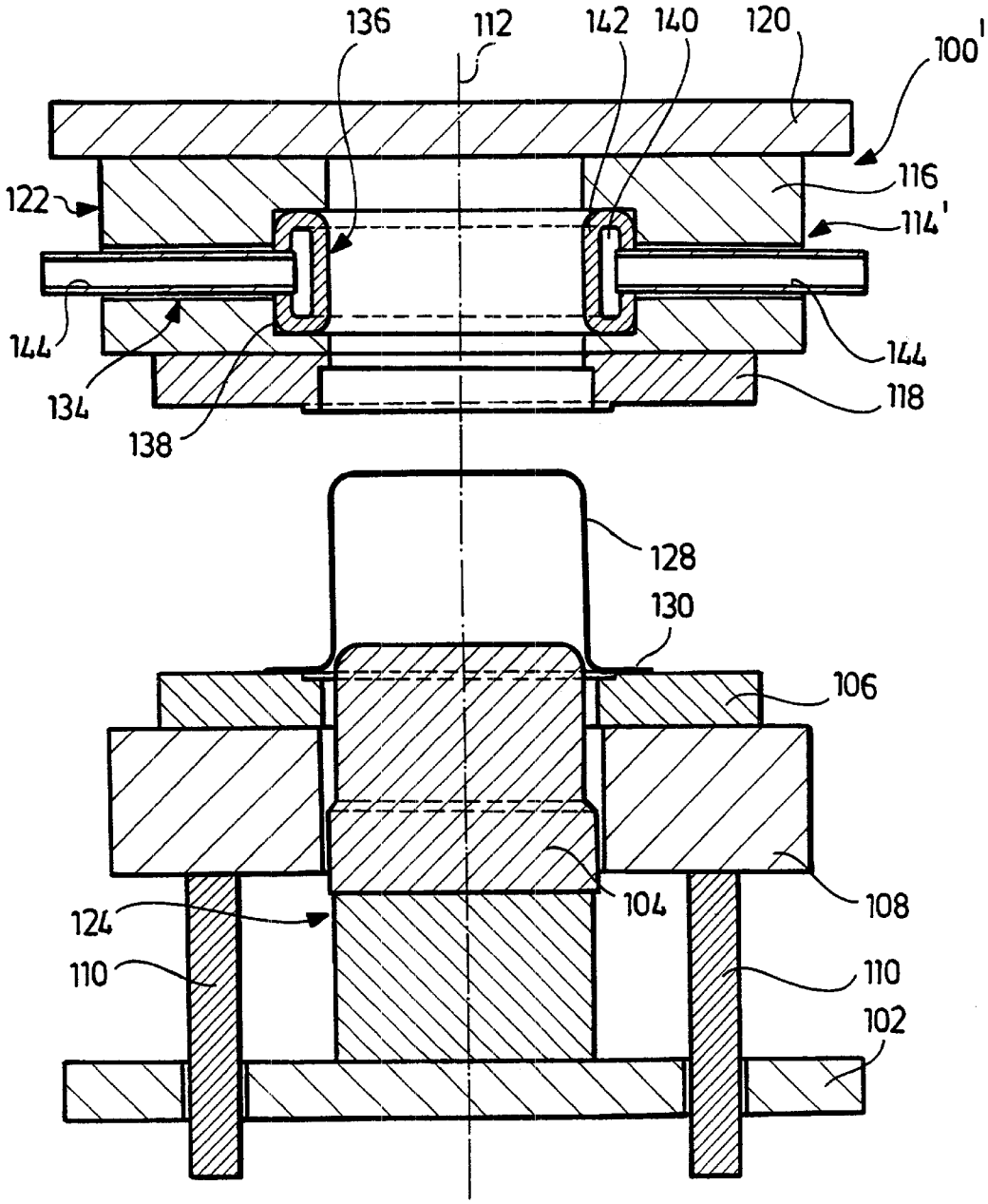
FIGS. 6–9 show schematic cross-sections through a deep-drawing die which comprises a pressure bubble ring in four different phases of an inventive deep-drawing process.

In order to carry out the required, additional formings of the drawn part 128, the same is subjected to a second deep-drawing process in a second deep-drawing die 100' (cf. FIG. 6).

The second deep-drawing die 100' corresponds in its fundamental construction to the first deep-drawing die 100 described above, wherein the drawing punch 104 and the drawing member 114' are shaped accordingly in order to obtain the desired forming of the drawn part 128.

Furthermore, the drawing member 114' of the second deep-drawing die 100' comprises a pressure generating device designated as a whole as 134 for generating a variable pressure.

The device 134 comprises, for its part, a pressure bubble ring 136 which is accommodated in an annular recess 138 on the inner side of the drawing ring support 116 and has an annular pressure bubble chamber 140 which is surrounded by a chamber wall 142 consisting of an elastically deformable material, for example polyurethane.

Fluid supply lines 144, via which a fluid subject to pressure, for example a hydraulic oil, can be supplied to the pressure bubble chamber 140 by a fluid pressure pump (not illustrated), are guided through the chamber wall 142 and open into the pressure bubble chamber 140.

A second deep-drawing process is carried out as follows with the second deep-drawing die 100' described above.

First of all, the second deep-drawing die 100' is opened in that the drawing member 114' and the sheet metal holder 106 are brought into their upper starting positions (cf. FIG. 6). Since the drawn part 128 is already preformed as a result of the first deep-drawing process, the upper side of the sheet metal holder 106 can be arranged, in its upper starting position, beneath the upper side of the drawing punch 104.

Subsequently, the deep-drawn part 128 resulting from the first deep-drawing process is inserted into the deep-drawing die 100' and placed on the sheet metal holder 106.

After that, the second deep-drawing die 100' is closed in that the drawing member 114' is displaced downwards along the direction of drawing 112 until the underside of the drawing ring 118 rests on the underside of the edge 130 of the drawn part 128 and the edge of the drawn part 128 is securely clamped between the drawing ring 118 and the sheet metal holder 106.

Figure 7:
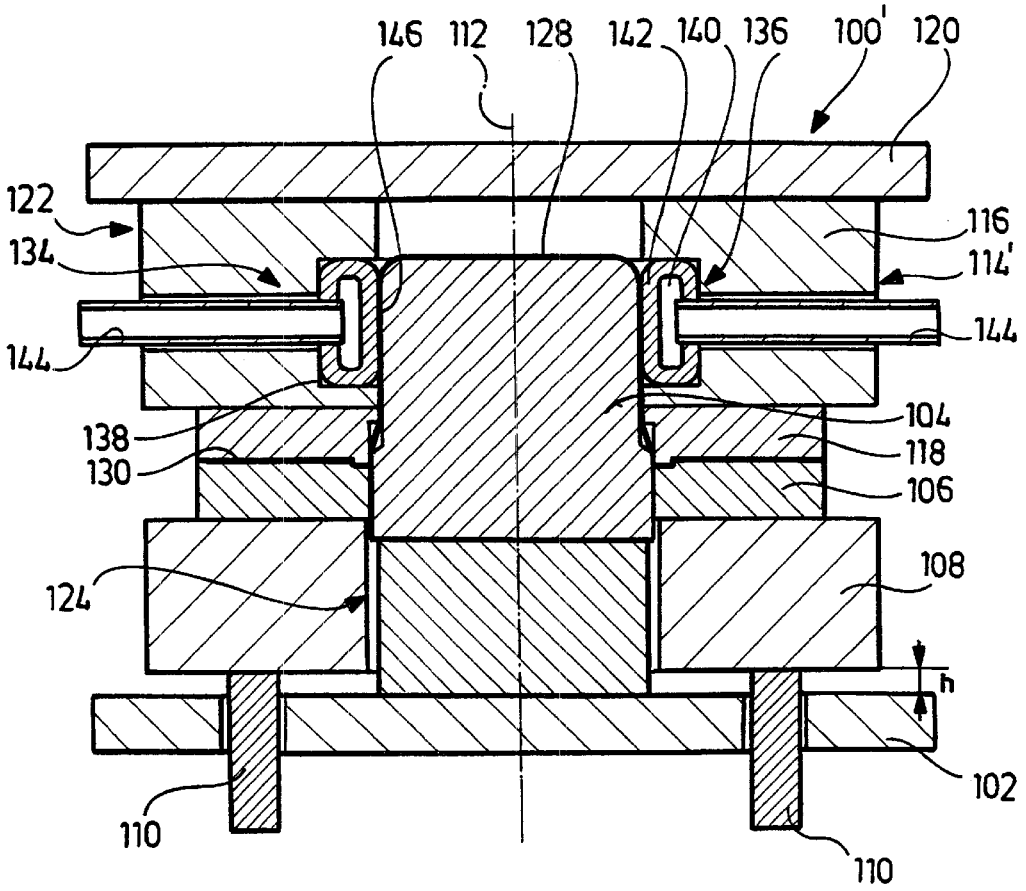

Subsequently, a first forming phase is carried out in that the spindle sleeves 110 with the supporting plate 108 arranged thereon and the sheet metal holder 106 are moved downwards along the direction of drawing 112 relative to the drawing punch 104 together with the drawing member 114' until the remaining drawing distance amounts to a distance h (cf. FIG. 7). During this first forming phase, the pressure bubble ring 136 is switched to no pressure, i.e., the fluid pressure pump is switched off or the fluid supply lines 144 are separated from the fluid pressure pump by a check valve (not illustrated) so that the fluid located in the pressure bubble chamber 140 is not subject to a higher pressure than the atmospheric pressure.

As soon as the remaining drawing distance corresponds to the distance h, the fluid in the pressure bubble chamber 140 is acted upon with an increased pressure p in that the fluid pressure pump is started and/or the check valve between the fluid pressure pump and the fluid supply lines 144 is opened. The elastically deformable chamber wall 142 of the pressure bubble ring 136 transfers the increased pressure of the fluid in the pressure bubble chamber 140 to the section of the side wall 146 of the drawn part 128 which abuts on the pressure bubble ring 136 and is formed by those side walls of the drawn part 128 aligned essentially parallel to the direction of drawing 112 so that this section of the side wall 146 is pressed against the drawing punch 104 under increased pressure.

The inner side of the pressure bubble ring 136 facing the drawn part 128 therefore serves as a pressure section 148 of the drawing member 114', by means of which a section of the drawn part 128 abutting on the pressure section 148 can be pressed against the drawing punch 104 selectively under a pressure variable with time during the drawing process.

Figure 8:
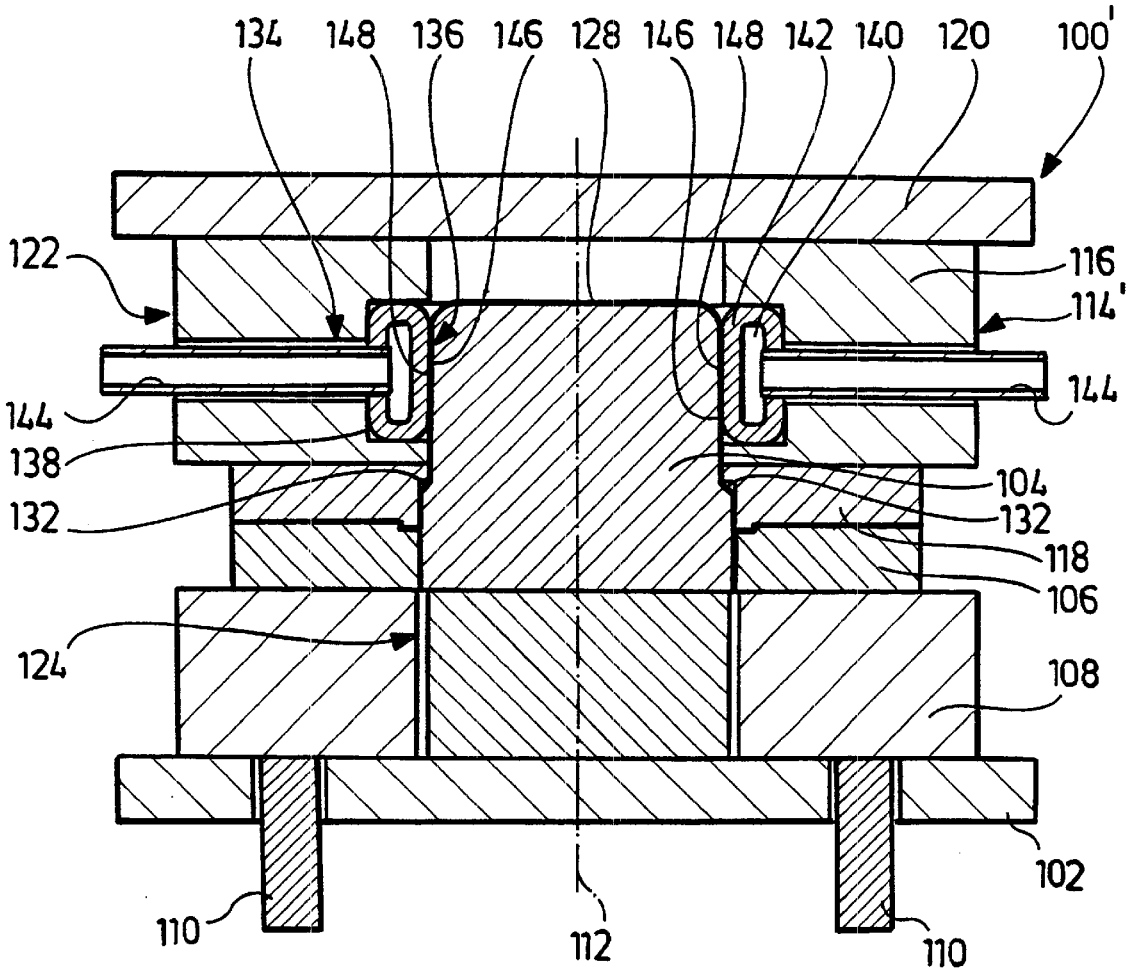

During a second forming phase, the drawn part 128 is completed in that the spindle sleeves 110 with the supporting plate 108 arranged thereon and the sheet metal holder 106 are moved downwards together with the drawing member 114' along the direction of drawing 112 relative to the drawing punch 104 until the desired drawing depth for the second deep-drawing process is reached (cf. FIG. 8).

In this respect, as a result of the side wall 146 of the drawn part 128 being acted upon with the pressure p by means of the pressure section 148 of the drawing member 114' a sufficient amount of material flows downwards during the forming of the drawn part 128 along the direction of drawing 112 in order to form the stacking lip 132 without cracks occurring in the drawn part 128.

Furthermore, it is ensured as a result of the side wall 146 being acted upon with the increased pressure p that the length and width of the drawn part 128 in the side wall area thereof are reduced to the desired values, and the bulging of the drawn part 128, which resulted during the first deep-drawing process, disappears.

Once the desired drawing depth has been reached at the end of the second forming phase, the pressure bubble ring 136 is again switched to no pressure in that the fluid pressure pump is switched off and/or the check valve between the fluid pressure pump and the fluid supply lines 144 to the pressure bubble ring 136 is closed.

Figure 9:
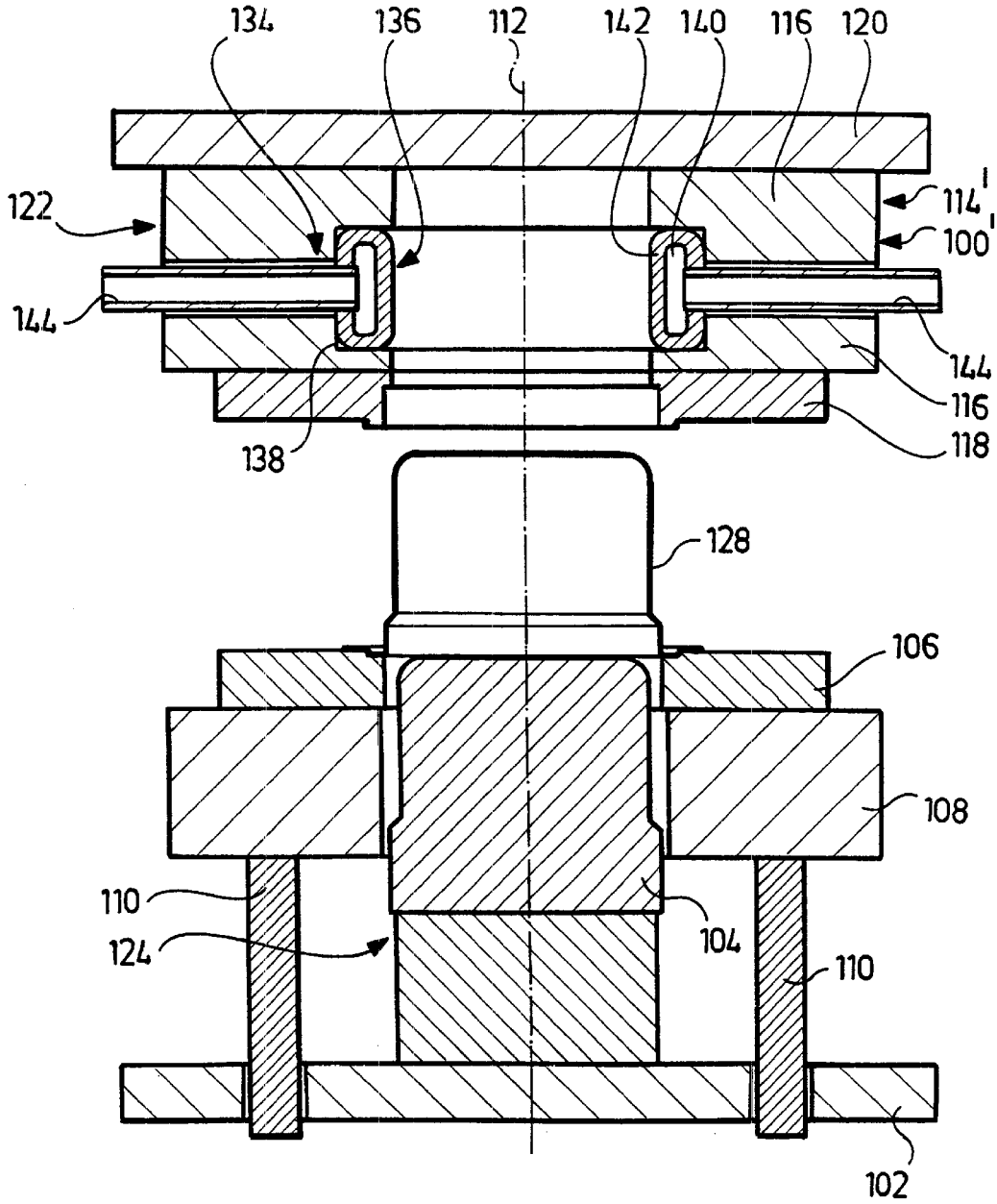

Subsequently, the second deep-drawing die 100' is opened in that the spindle sleeves 110 with the supporting plate 108 arranged thereon and the sheet metal holder 106 are displaced into the upper starting position and, subsequently, the drawing member 114' is displaced further along the direction of drawing 112 upwards into its upper starting position so that the completely drawn part 128 is accessible from outside the deep-drawing die 100' and can be removed from the deep-drawing die 100' (cf. FIG. 9).

Figure 10:
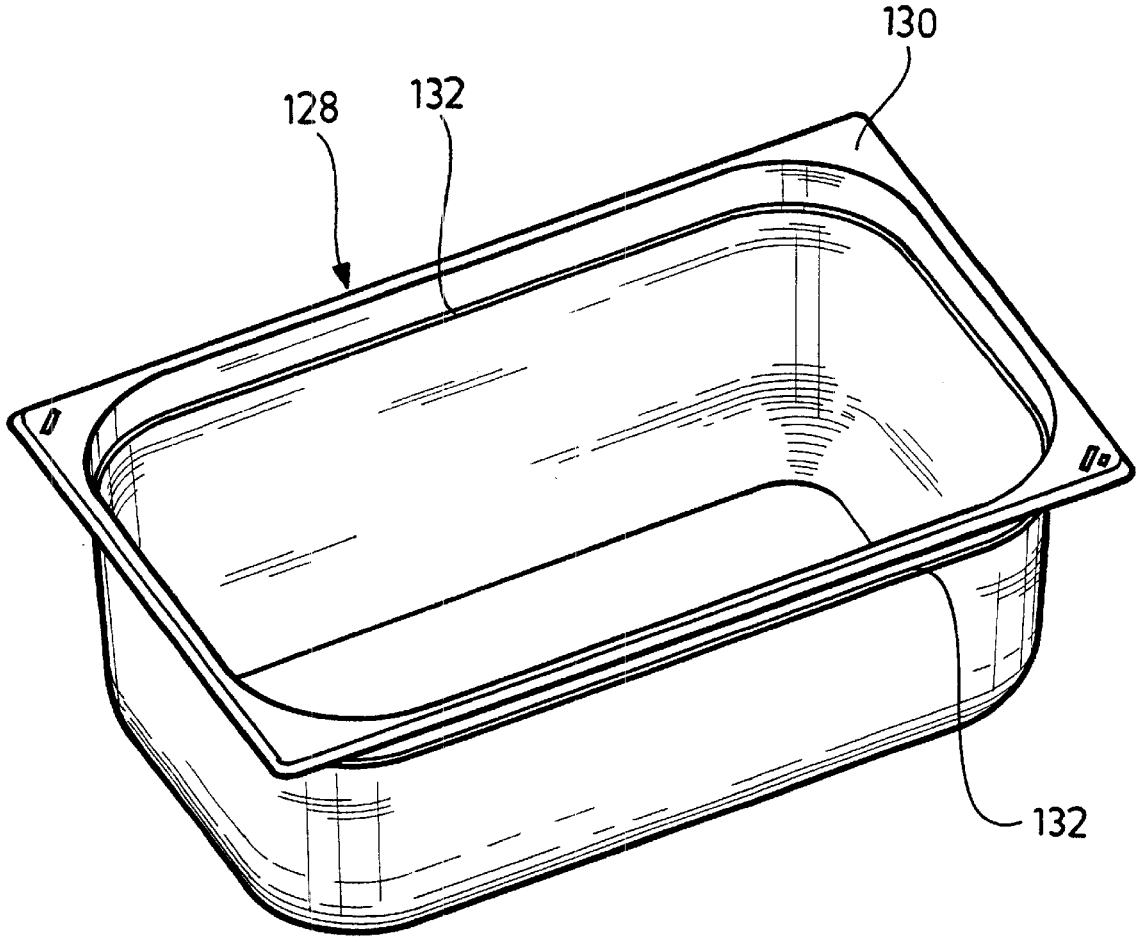
FIG. 10 shows a schematic perspective illustration of a drawn part after two deep-drawing processes.

The drawn part 128 now has the desired final shape of a Gastronorm food container (cf. FIG. 10).

Figure 11:
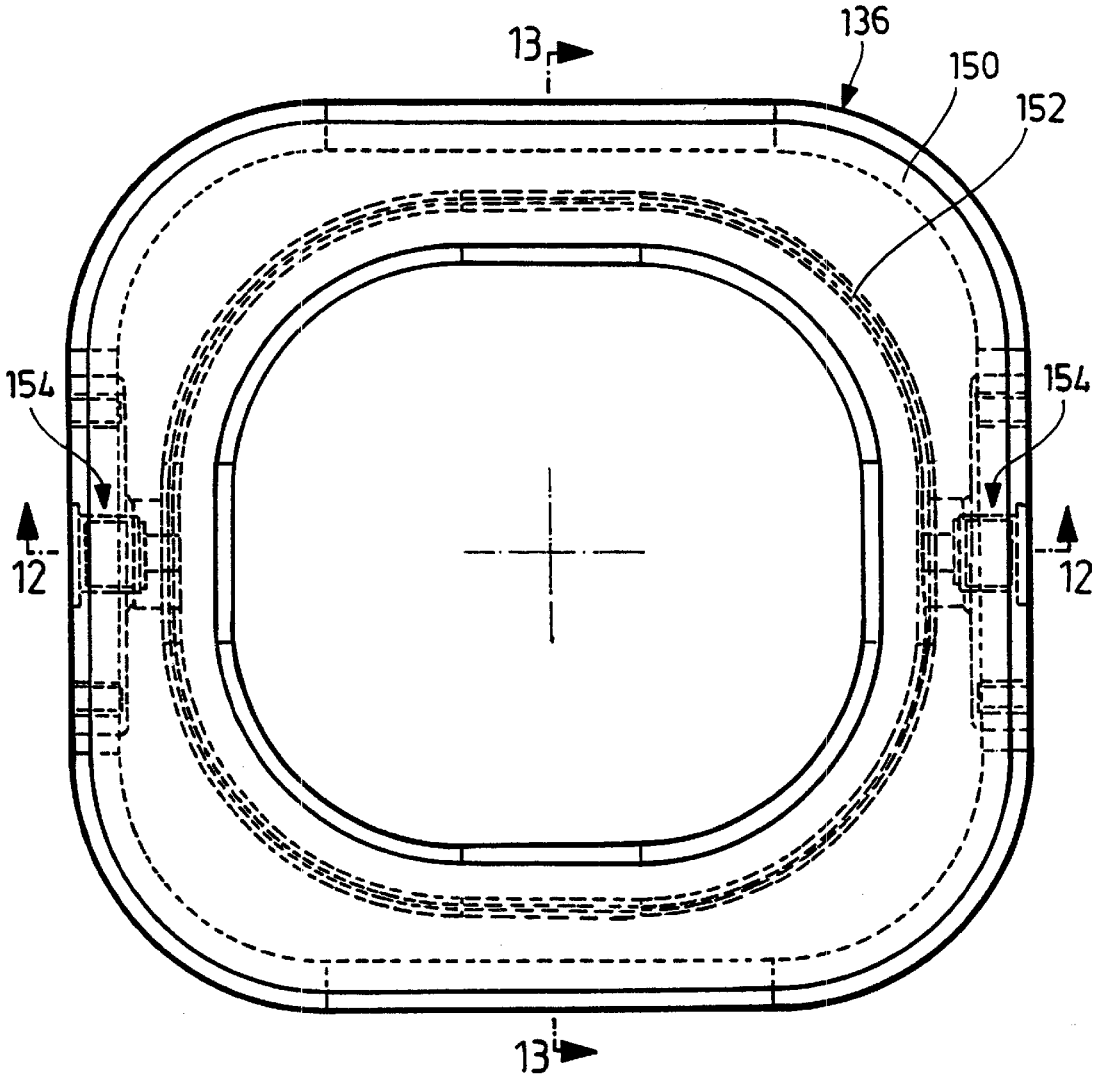
FIG. 11 shows a plan view of a pressure bubble ring.
Figure 12:
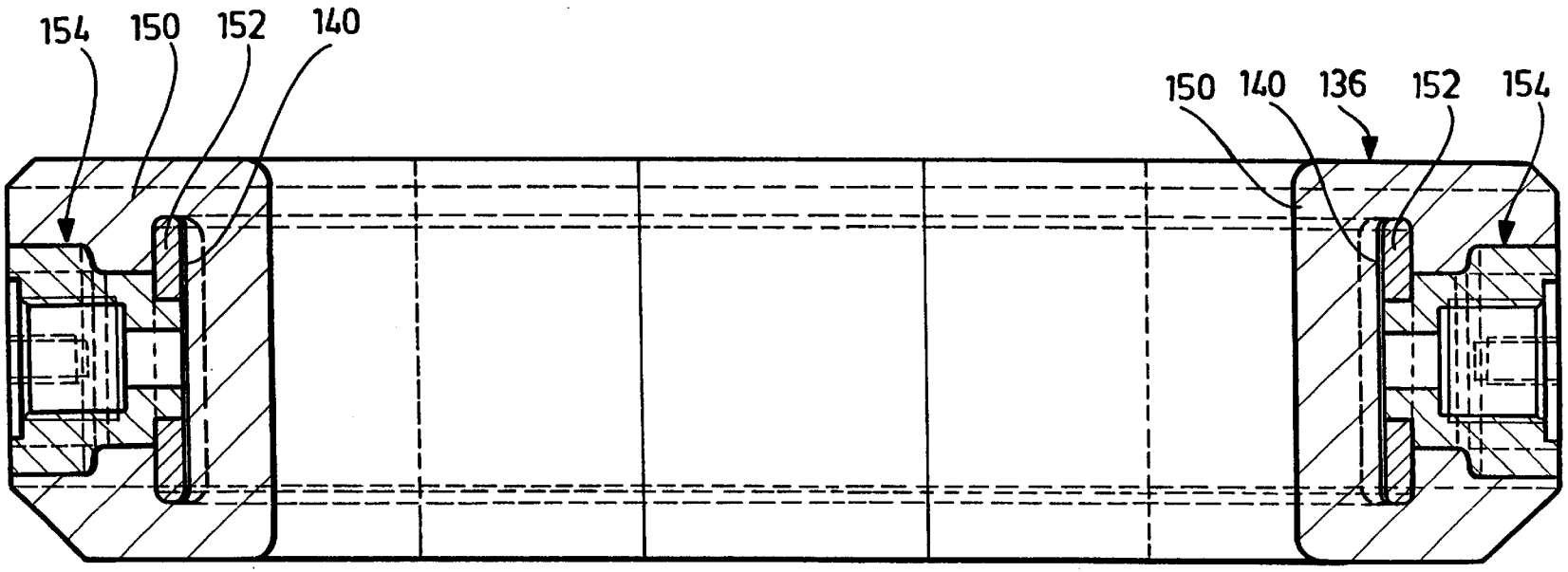
FIG. 12 shows a cross-section through the pressure bubble ring from FIG. 11 along line 12—12 in FIG. 11.
Figure 13:
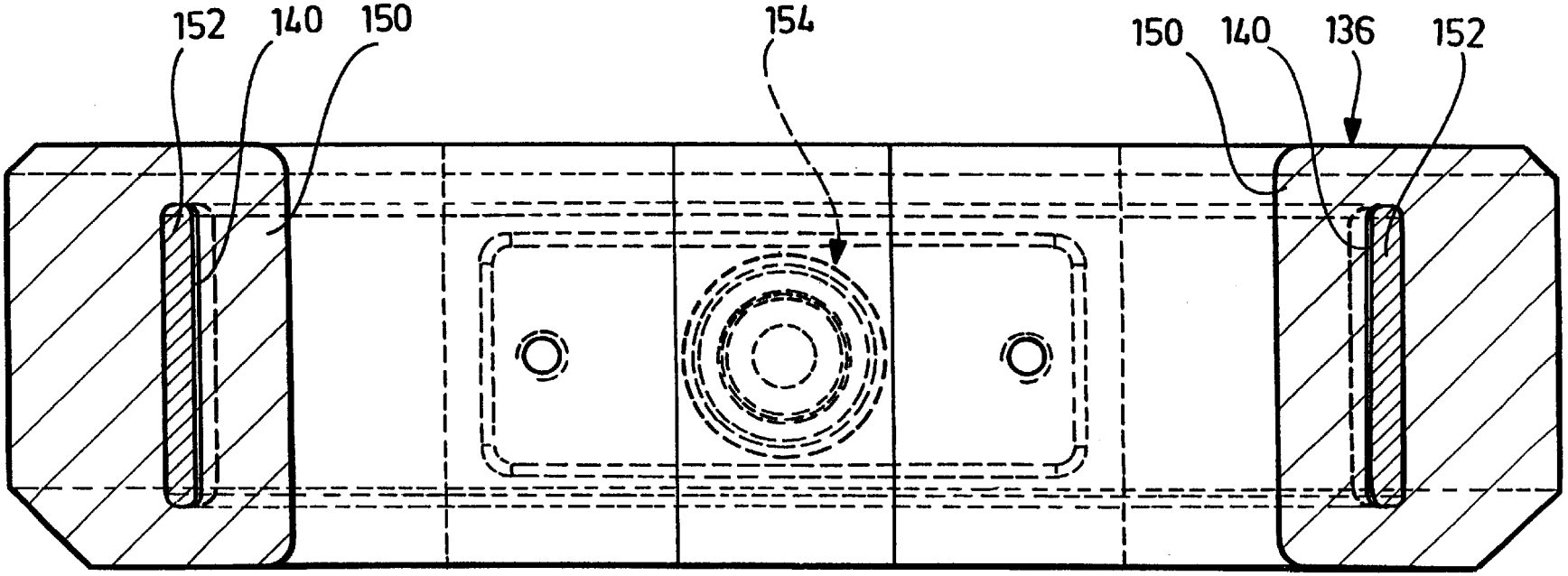
FIG. 13 shows a cross-section through the pressure bubble ring from FIG. 11 along line 13—13 in FIG. 11.

FIGS. 11 to 13 show in detail a preferred embodiment of a pressure bubble ring 136 as can be used in the inventive deep-drawing method.

As is best apparent from the cross-sections of FIGS. 12 and 13, the pressure bubble ring 136 comprises an outer ring 150 consisting of an elastically deformable material, for example polyurethane, into which a chamber limiting ring 152, which can consist, for example, of a metallic material, in particular aluminum, is embedded.

The outer ring 150 is produced in that the chamber limiting ring 152 is introduced into a casting mold, the inner contours of which correspond to the outer contours of the outer ring 150, and the space between the casting mold and the chamber limiting ring 152 is cast with polyurethane.

In this respect, the inner side of the chamber limiting ring 152 is provided with a separating agent so that the outer ring 150 consisting of polyurethane adheres only to the outer side of the chamber limiting ring 152 whereas the material of the outer ring 150 can be lifted away from the chamber limiting ring 152 at the inner side of the chamber limiting ring 152.

At two locations of the pressure bubble ring 136 diametrically opposite one another, the chamber limiting ring 152 has a respective connection member 154, for example, consisting of steel passing through it and this leads from the chamber limiting ring 152 as far as the outer side of the outer ring 150 and can be connected at its outer end to a fluid supply line 144.

Fluid supplied through the fluid supply line 144 can pass through the connection member 154 into the space between the outer ring 150 and the chamber limiting ring 152 at the inner side of the chamber limiting ring 152 and lift the material of the outer ring 150 away from the chamber limiting ring 152 so that a pressure bubble chamber 140 is formed between the chamber limiting ring 152 and the outer ring 150, the volume of this pressure bubble chamber 140 being dependent on the pressure, to which the fluid is subject. If this pressure is low, the pressure bubble chamber 140 has only a slight volume (corresponding to the solid boundary line in FIGS. 12 and 13). If the pressure of the fluid is high, the volume of the pressure bubble chamber 140 increases accordingly (cf. the dashed boundary lines in FIGS. 12 and 13).

If the outer ring 150 of the pressure bubble ring 136 is produced from polyurethane, a hydraulic oil can be used as pressure fluid for filling the pressure bubble chamber 140.

If, alternatively hereto, the outer ring 150 of the pressure bubble ring 136 is produced from natural rubber, castor oil is, for example, to be used instead as pressure fluid since natural rubber is corroded by hydraulic oil.

What is claimed is:

1. Deep-drawing method for forming a drawn part having a side wall in a deep-drawing die between a first deep-drawing die part and a second deep-drawing die part, said method comprising:

forming said drawn part by way of relative movement of the deep-drawing die parts in relation to one another; and generating a pressure variable with time during the drawing process selectively at a limited pressure section of one of the deep-drawing die parts, said pressure variable with time pressing exclusively the side wall of the drawn part abutting the pressure section against the other deep-drawing die part.

2. Deep-drawing method as defined in claim 1, including generating the pressure at the pressure section hydraulically by means of a pressure fluid.

3. Deep-drawing method as defined in claim 1, including controlling the pressure at the pressure section in accordance with a predetermined temporal pressure course.

4. Deep-drawing method as defined in claim 1, wherein the pressure section is aligned essentially parallel to the direction of drawing, and including moving the deep-drawing die parts relative to one another along said direction.

5. Deep-drawing method as defined in claim 1, including giving the pressure section a ring shape.

6. Deep-drawing method as defined in claim 1, including generating the pressure variable with time by means of a pressure generating device comprising a chamber for accommodating a pressure fluid subject to pressure and an elastically deformable chamber wall for transferring the pressure from the pressure fluid to the drawn part.

7. Deep-drawing method as defined in claim 6, including giving the chamber a ring shape.

8. Deep-drawing method as defined in claim 6, including limiting the chamber partially by the elastically deformable chamber wall and partially by a chamber limiting wall, and forming the chamber limiting wall and the elastically deformable chamber wall of different materials.

9. Deep-drawing method as defined in claim 8, wherein the chamber limiting wall consists of a metallic material.

10. Deep-drawing method as defined in claim 8, wherein the chamber limiting wall consists of aluminum.

11. Deep-drawing method as defined in claim 1, wherein the first deep-drawing die part forms a drawing member and the second deep-drawing die part forms a drawing punch, and including arranging the pressure section on the drawing member.

12. Deep-drawing method as defined in claim 11, wherein the drawing punch is stationary during the drawing process, and including moving the drawing member towards the drawing punch.

13. Deep-drawing method as defined in claim 1, including generating the pressure at the pressure section pneumatically by means of a pressure fluid.

14. Deep-drawing method according to claim 1, including arranging the side wall of the part substantially parallel to the direction of relative movement of the die parts.

15. Deep-drawing method as defined in claim 1, including preforming the drawn part in a first drawing process and postforming the drawn part in a second drawing process, and wherein generating the pressure variable with time at the pressure section is performed during said second drawing process.

16. Deep-drawing die, comprising a first deep-drawing die part and a second deep-drawing die part, a drawn part having a side wall being formable in said die by way of relative movement of the deep-drawing die parts in relation to one another, wherein one of the deep-drawing die parts has a limited pressure section, said deep-drawing die comprising a pressure generating device for generating a pressure variable with time selectively at said pressure section during the drawing process, said pressure variable with time pressing exclusively the side wall of the drawn part abutting on the pressure section against the other deep-drawing die part.

17. Deep-drawing die as defined in claim 16, wherein the pressure at the pressure section is generatable hydraulically by means of a pressure fluid.

18. Deep-drawing die as defined in claim 16, wherein the pressure at the pressure section is controllable in accordance with a predetermined temporal pressure course.

19. Deep-drawing die as defined in claim 16, wherein the pressure section is aligned essentially parallel to the direction of drawing, the deep-drawing die parts being movable relative to one another along said direction.

20. Deep-drawing die as defined in claim 16, wherein the pressure section is ring-shaped.

21. Deep-drawing die as defined in claim 16, wherein the pressure generating device comprises a chamber for accommodating a pressure fluid subject to pressure and an elastically deformable chamber wall for transferring the pressure from the pressure fluid to the drawn part.

22. Deep-drawing die as defined in claim 21, wherein the chamber is ring-shaped design.

23. Deep-drawing die as defined in claim 21, wherein the chamber is limited partially by the elastically deformable chamber wall and partially by a chamber limiting wall consisting of a material different from the material of the elastically deformable chamber wall.

24. Deep-drawing die as defined in claim 23, wherein the chamber limiting wall consists of a metallic material.

25. Deep-drawing die as defined in claim 23, wherein the chamber limiting wall consists of aluminum.

26. Deep-drawing die as defined in claim 16, wherein the first deep-drawing die part defines a drawing member and the second deep-drawing die part defines a drawing punch, and wherein the pressure section is arranged on the drawing member.

27. Deep-drawing die as defined in claim 26, wherein the drawing punch is stationary and the drawing member is movable towards the drawing punch.

28. Deep-drawing die as defined in claim 16, wherein the pressure at the pressure section is generatable pneumatically by means of a pressure fluid.

29. Deep-drawing die according to claim 16, wherein the side wall is substantially parallel to the direction of relative movement between the die parts.

30. Deep-drawing method for forming a drawn part arranged in a deep-drawing die between a first deep-drawing die part and a second deep-drawing die part, said method comprising:

forming said drawn part by way of relative movement of the deep-drawing die parts in relation to one another; and generating a pressure variable with time during the drawing process selectively at a limited pressure section of one of the deep-drawing die parts, said pressure pressing a section of the drawn part abutting the pressure section against the other deep-drawing die part, generating the pressure variable with time with a pressure generating device comprising a chamber for accommodating a pressure fluid subject to pressure, limiting said chamber partially with an elastically deformable chamber wall for transferring the pressure from the pressure fluid to the drawn part and partially with a ring-shaped chamber limiting wall consisting of a material different from the material of the elastically deformable chamber wall.

31. Deep-drawing method for forming a drawn part having a side wall in a deep-drawing die between a first deep-drawing die part and a second deep-drawing die part, said method comprising:

forming said drawn part by moving the deep-drawing die parts relative to one another in a direction substantially parallel to the side wall; and generating a pressure variable with time during the drawing process selectively at a limited pressure section of one of the deep-drawing die parts, said pressure variable with time pressing solely the side wall of the drawn part abutting the pressure section against the other deep-drawing die part.

32. Deep-drawing die, comprising a first deep-drawing die part and a second deep-drawing die part, a drawn part being formable in said die by way of relative movement of the deep-drawing die parts in relation to one another, wherein one of the deep-drawing die parts has a limited pressure section, said deep-drawing die comprising a pressure generating device for generating a pressure variable with time selectively at said pressure section during the drawing process, said pressure pressing a section of the drawn part abutting on the pressure section against the respectively other deep-drawing die part, wherein said pressure generating device comprises a chamber for accommodating a pressure fluid subject to pressure, said chamber being limited partially by an elastically deformable chamber wall for transferring the pressure from the pressure fluid to the drawn part and partially by a ring-shaped chamber limiting wall consisting of a material different from the material of the elastically deformable chamber wall.

33. Deep-drawing die for forming a drawn part having a side wall, comprising a first deep-drawing die part and a second deep-drawing die part, the drawn part being formable in said die by relative movement of the deep-drawing die parts in a direction substantially parallel to the side wall of the drawn part, one of the deep-drawing die parts having a pressure section, and a pressure generating device for generating a pressure variable with time at said pressure section during the drawing process and pressing solely the side wall of the drawn part abutting the pressure section against the other deep-drawing die part.

* * * * *

UNITED STATES PATENT AND TRADEMARK OFFICE

CERTIFICATE OF CORRECTION

PATENT NO. : 6,622,539 B2
DATED : September 23, 2003
INVENTOR(S) : Josef Hautzinger et al.

It is certified that error appears in the above-identified patent and that said Letters Patent is hereby corrected as shown below:

Title page,
Item [12], change the inventor "Hartzinger et al." to -- Hautzinger et al. --.
Item [75], Inventor, change the first inventor's name from "Josef Hartzinger" to -- Josef Hautzinger --.

Signed and Sealed this

Thirtieth Day of March, 2004

JON W. DUDAS
*Acting Director of the United States Patent and Trademark Office*